US005932388A

United States Patent [19]

Umeno et al.

[11] Patent Number: 5,932,388

[45] Date of Patent: Aug. 3, 1999

[54] CARRIER FOR DEVELOPING ELECTROSTATIC IMAGE, DEVELOPER AND DEVELOPING METHOD

[75] Inventors: Tomoyasu Umeno; Meizo Shirose; Tatsuya Nagase; Ryuji Kitani, all of Hachioji, Japan

[73] Assignee: Konica Corporation, Japan

[21] Appl. No.: 08/959,052

[22] Filed: Oct. 28, 1997

[30] Foreign Application Priority Data

| | | | |
|---|---|---|---|
| Oct. 31, 1996 | [JP] | Japan | 8-289813 |
| Nov. 6, 1996 | [JP] | Japan | 8-283651 |
| Dec. 26, 1996 | [JP] | Japan | 8-347617 |

[51] Int. Cl.[6] ..... G03G 9/113

[52] U.S. Cl. ..... 430/108; 430/106.6

[58] Field of Search ..... 430/106, 108, 430/106.6

[56] References Cited

U.S. PATENT DOCUMENTS

| | | | |
|---|---|---|---|
| 4,822,708 | 4/1989 | Machida et al. | 430/108 |
| 5,093,201 | 3/1992 | Ohtani et al. | 430/108 |
| 5,441,839 | 8/1995 | Ishikawa et al. | 430/108 |
| 5,576,134 | 11/1996 | Ogawa et al. | 430/108 |

*Primary Examiner*—John Goodrow

*Attorney, Agent, or Firm*—Jordan B. Bierman; Bierman, Muserlian and Lucas

[57] ABSTRACT

A carrier for a developer developing an electrostatic image is disclosed. The carrier contains magnesium from 2.0 to 25.0 by means of number of atoms by percent in surface portion. According to the invention excellent charge rising properties may be consistently exhibited for extended time periods, and neither toner scattering nor background deposits on images are caused.

10 Claims, No Drawings

CARRIER FOR DEVELOPING ELECTROSTATIC IMAGE, DEVELOPER AND DEVELOPING METHOD

FIELD OF THE INVENTION

The present invention relates to a carrier for developing an electrostatic image, a developer and a developing method, and more specifically to a carrier for developing an electrostatic image, a developer and a developing method in which stable charge rising properties are exhibited, and neither toner scattering nor background deposits on images are caused.

BACKGROUND OF THE INVENTION

The two component developer which is employed in imaging machines such as copiers, printers and the like utilizing electrophotographic system is generally composed of a mixture consisting of a negatively charged toner and a positively charged carrier against the polarity of the charge of the toner. And the carrier is employed so as to enable the toner with an appropriate amount of triboelectric charge having a negative polarity.

In recent years, imaging machines such as laser printers in which the electrophotographic system is employed have tended to miniaturization. In accordance with the trend, in addition to the miniaturization of the imaging machines themselves, in particular, developing devices including developing units have been also miniaturized. In the small-sized developing device, there is inevitably provided a small amount of a developer for developing electrostatic images.

On account of the fact above, in the aforementioned two component developer to be negatively charged, it is required that an appropriate amount of trioboelectric charge is applied to the toner, that is, the charge rising properties are improved during a short period between the receipt of the toner and the transport to a developing zone for developing electrostatic latent images.

In view of the foregoing, as means for improving the charge rising properties, for example, Japanese Patent Publication Open to Public Inspection No. 2-8860 and the like disclose technology in that a charge control agent to be charged positively is added to and contained in a resin coating layer in a resin coated carrier.

Known charge control agents to be positively charged include quaternary ammonium compounds disclosed in Japanese Patent Publication Open to Public Inspection Nos. 49-51951 and 52-10141 and alkylpyridinium compounds and alkylpicolium compounds (for example, nigrosine SO, nigrosine EX, etc.) disclosed in Japanese Patent Publication Open to Public Inspection Nos. 56-11461 and 54-158932.

Conventionally known charge control agents to be positively charged have been organic compounds having a large cohesive force and have been inferior in being dispersed to and mixed with a coating resin. On account of the fact, it has been impossible to disperse uniformly the charge control agent to be positively charged to the resin coating layer of the carrier and to enable the toner with an appropriate amount of the negative triboroeletric charge. As a result, there has been a provided a problem in that toner scattering and background deposits on images are caused due to the fact that the toner is not enabled with an appropriate amount of the negative triboroelectric charge.

SUMMARY OF THE INVENTION

An object of the present invention is to provide a carrier, a developer and an imaging method wherein excellent charge rising properties may be consistently exhibited for extended time periods, and neither toner scattering nor background deposits on images are caused.

The carrier and its embodiments of the present invention are explained in detail.

A carrier for a developer developing an electrostatic image wherein the carrier contains magnesium from 2.0 to 25.0 by means of number of atoms by percent in the surface portion.

A carrier for developing an electrostatic image may be prepared in such a manner that the surface of a particle of a magnetic substance is coated with a resin.

These carriers for developing an electrostatic image constitute developers for developing an electrostatic image by combining a toner comprising at least a binding resin and a colorant.

A developer comprised of a carrier for developing electrostatic images, in which the surface of the particle of a magnetic substance is coated with a resin and a toner comprising a binding resin and a colorant is employed, when upon forming a developer layer on a developer holding member, an electrostatic image on an electrostatic image holding member is then developed.

DETAILED DESCRIPTION OF THE INVENTION

Carrier

The carrier has a feature in the arrangement of atoms on the surface portion of the carrier. Specifically, the magnesium atom containing ratio in the surface portion of the resin coated carrier is in the range of 2.0 to 25.0 (the number of atoms by percent). The "surface portion of the resin coated carrier" indicates a depth of 20 nm or less from the surface of the resin coated carrier.

Magnesium has such characteristics that it is an atom having large electron donating capability and itself is subject remarkably to positive charging, that is, negative charge donating capability is large. When the aforementioned magnesium atom containing ratio of (hereinafter referred to as "Mg amount") is in the range of 2.0 to 25.0 (the number of atoms by percent), both of the charge rising properties and charge holding properties are excellent and negative charge donating properties to a toner is remarkably enhanced. Based on those, preferred charge rising properties are obtained. Furthermore, during mixing even for a long period of time or under an environment of high humidity, the negative charge donating properties to the toner is stable and result in the prevention of the toner scattering and background deposits on images.

The magnesium atom containing ratio in the surface portion can be measured using an X-ray photoelectric spectroscopic analysis apparatus (XPS). Specifically, quantitative analysis of each element is performed using an X-ray photoelectric spectroscopic analysis apparatus ESCA-1000 (manufactured by Shimadzu Co., Ltd.) under the following analytical conditions and the magnesium atom containing ratio is derived from the peak area of each element according to the following formula.

Magnesium atom containing ratio (Mg amount)=(Peak area of magnesium atom)/(total of peak areas of total 5 elements of C, O, Fe Si and Mg)

(Analytical Conditions)

X-ray: Mg anode type (1253.6 eV)

Acceleration: 10 kV, 30 mA

Resolving power: 31.5 eV

Measured elements: carbon, oxygen, iron, silicon, magnesium

Carrier Composing Materials for the Present Invention

As particles of magnetic substances constituting the carrier, may be employed (1) substances which are strongly magnetized in the direction by magnetic field such as, for example, ferromagnetic metals such as iron, ferrite, magnetite and further, iron nickel, cobalt, etc., its alloys or compounds containing any of these elements, (2) alloys comprising no ferromagnetic metal, which are subjected to suitable thermal treatment to exhibit the ferromagnetism such as manganese-copper-aluminum or manganese-copper-tin, etc. termed Heusler's alloy, or (3) particles of magnetic substances such as particles composed of chromium dioxide, etc. There is no particular limitation on the shape of particles of magnetic substances. However, spherical shape is preferred. The specific gravity of particles of magnetic substances is preferably from 3 to 7 from a view point of preventing the destruction of the resin coated layer during stirring a mixture in a developing device and fusion of toner constituting materials onto the surface of the carrier.

With the consideration of the stability in enabling a toner with charge, capability for transferring the toner to an electrostatic latent image, transfer of the carrier to the electrostatic latent image, adhesion of the carrier, etc., the carrier having a volume average particle diameter of 15 to 80 $\mu$m is preferably employed. Further, the volume average particle diameter is measured using a laser diffraction particle distribution measurement apparatus HELOS manufactured by Nihon Denshi Co., Ltd. In a 50 cc beaker, a sample carrier, a surface active agent and water as a dispersing medium are put and the resulting mixture was then dispersed for 120 seconds using an ultrasonic homogenizer having an output of 150 W. The particle size distribution was then measured.

The magnesium atom containing material constituting the carrier includes magnesium oxide, magnesium hydroxide, magnesium carbonate and these mixtures, or compound oxides of magnesium with metals such as calcium, aluminum, silica, etc. Among these, magnesium oxide, magnesium hydroxide and magnesium carbonate are preferably employed. In addition, a mixture comprising these two or more may be employed.

Magnesium oxide may be prepared by oxidizing (combustion) magnesium or decomposing thermally magnesium carbonate, magnesium hydroxycarbonate or magnesium hydroxide. Moreover, evaporated magnesium may be oxidized under oxygen to form single crystals.

Magnesium hydroxide can be prepared by adding an alkali to an aqueous magnesium compound solution prepared by dissolving any of magnesium oxide, magnesium carbonate, magnesium hydroxycarbonate, etc. in water and heating the resulting solution under increased pressure. Furthermore, evaporated magnesium can be oxidized under steam comprising no carbon dioxide to grow single crystals.

Magnesium carbonates include magnesium hydroxycarbonate of which compositions are represented by (3 to 5)$MgCO_3.Mg(OH)_2$. (3 to 7)$H_2O$ except for the compound represented by $MgCO_3$. Among these magnesium carbonates, for example, trihydrated polycrystals can be prepared by adding under carbon dioxide flow sodium carbonate to an aqueous magnesium compound solution. Furthermore, evaporated magnesium can be oxidized under carbon dioxide flow to grow single crystals.

Weight decreasing ratio (hereinafter referred to as "W (loss)") which represents a scale showing an amount of hydrated water in these magnesium compounds is preferably from 2 to 30 percent by weight in the temperature region of 200 to 500° C. upon heating at a rate of 5° C./minute under atmosphere, because the triboelectric charge donating properties are stabilized against variations in environment.

The weight decreasing ratio "W (loss)" is measured herein under atmosphere using a thermal gravimetric analytical apparatus TGA-50 manufactured by Shimadzu Co., Ltd.

The magnesium atom containing ratio in the surface portion of a magnesium atom containing material is preferably from 20 to 40 (the number of atoms by percent). When used as a carrier constituting material which is in the aforementioned range, negative charge donating properties of the carrier to a toner may be remarkably improved. The magnesium atom containing ratio in the surface portion of the aforementioned magnesium atom containing material is measured herein in the same way as for that in the surface portion of the carrier.

The BET specific surface area of the aforementioned magnesium atom containing material is preferably from 20 to 300 $m^2/g$. The number average particle diameter is preferably from 10 nm to 3 $\mu$m. Based on this, the magnesium atom containing material may be dispersed uniformly to a resin coated layer. As a result, the properties enabling a toner with a negative polarity may be remarkably improved. The BET specific surface area of the magnesium atom containing material is measured herein using a Micromeritics flowsorp II2300 type manufactured by Micromeritics Co. The number average particle diameter indicates herein a unit number average particle diameter of primary particles (particle which is individually separated into a unit particle) of the magnesium atom containing material which is present in a fine particle-like state. The unit number average particle diameter is herein measured by such a way that for example, a photographic image observed and photographed by a transmission type electron microscope (TEM) JEM-2000FX (manufactured by Nihon Denshi Co., Ltd.) is supplied to an image analyzing apparatus SPICCA (Nihon Abionix Co., Ltd.) and the unit number average particle diameter is measured thereby.

There is no particular limitation on the coating resin constituting the carrier, if it enables the aforementioned toner with a negative polarity caused by triboelectric charging with the toner. For example, are preferred styrene series resins, acryl series resins, styrene-acryl series copolymer resins, and these blend resins form a viewpoint of charge applying properties, coating layer forming capability (film forming capability), etc.

The coating resins which have a glass transition point Tg) of 50 to 200° C. and a softening point of 80 to 300° C. are preferable because adhesion is strong against the surface of a core particle and the improvement in durability is achieved. The glass transition point (Tg) is defined herein as the value (hereinafter, the same definition is applied.) measured using DSC 506S (manufactured by Seiko Denshi Co., Ltd.) and the softening point (Tsp) is defined herein as the value (hereinafter, the same definition is applied.) measured using a Koka type flowtester CFT-500 (manufactured by Shimadzu Co., Ltd.)

The coating resin has preferably a spherical fine particle-like shape and the unit number average primary particle diameter is preferably from 0.01 to 10 $\mu$m. Such the fine particle-like resin may be prepared by suspension polymerization, emulsion polymerization, soap-free emulsion polymerization, etc. The unit number average primary particle diameter of the coating resin is measured using a particle distribution measuring apparatus. An example of the apparatus is LPA-3000/3100 (manufactured by Ootsuka Denshi Co., Ltd.).

Preparation Methods of the Carrier of the Present Invention

The carrier of the present invention may be prepared using various methods conventionally known in the art. For example, a resin coated magnetic carrier utilizing particles of magnetic substances such as iron, ferrite, magnetite, etc. as cores is prepared by a method generally termed a wet method wherein the coating resin is dissolved in a suitable organic solvent; a coating solution is then prepared by mix dispersing a magnesium containing material to the resulting solution; with the use of the coating solution, a coating layer is formed on the surface of the particle of the magnetic substance using a method such as a dipping method, a dry-spray method, a fluidized bed method, etc. and the resulting is then heated or rested. Or the preparation may be performed using a method generally termed a dry method which employs no solvent when forming a coating layer.

The carrier is preferably prepared by forming a resin coating layer on the surface of a particle of a magnetic substance using a dry coating in which resin particles and a magnesium atom containing material are supplied to the surface of the particle of the magnetic substance by mechanical impact and fixed. Such production is particularly preferred that after a mixture is prepared by mixing with stirring the particles of the magnetic substance and resin particles, the magnesium atom containing material is added to the resulting mixture.

The magnesium containing material is mixed with stirring with the particles of the magnetic substance and resin particles is then added. The presence of the magnesium containing material may be localized to the surface portion of the carrier as compared to that of a carrier prepared using the conventional method. As a result, excellent negative charge donating properties to a toner may be obtained. Due to the advantages, excellent charge rising properties of the developer may be maintained for extended time periods.

Specifically, as illustrated in Examples, particles of a magnetic substance, a coating resin and a magnesium atom containing material are mixed with stirring in a high speed stirring type mixer and the mixture is prepared in which the coating resin and the magnesium atom containing material are adhered on the surface of the particle of the magnetic substance. The temperature of the mixture is then raised further; the mixture is mixed with stirring similarly in the high speed stirring type mixer and by applying repeatedly mechanical impact force to the mixture, the carrier may be prepared in which on the surface of the particle of the magnetic substance composed of the magnetite, a resin coating layer comprising the magnesium compound is formed.

In the preparation, the coating amount of the aforementioned coating resin is generally from 0.05 to 6.0 percent by weight of core particles such as ferrite particles, etc. Furthermore, for controlling the resistance value of the carrier and achieving various other purposes, an intermediate layer comprised of a resin and other materials may be arranged between the aforementioned coating resin and particle of the core material.

A developer is composed in accord to a toner.

As binding resins constituting the toner, may be employed styrene series resins, acryl series resins, styrene-acryl series copolymers, styrene-butadiene copolymers, epoxy resins, polyester resins and other binding resins.

Developing Apparatus

The developing apparatus is fabricated as follows. The aforementioned developer layer is formed on a developer holding member composed of non-magnetic materials such as aluminum, SUS and the like accommodating in its inside a magnet roll equipped with many N, S arranged against an electrostatic image holding member. While rotating the developer holding member, the developer layer is in contact with or adjacent to an electrostatic latent image part on the electrostatic charge holding member and the latent image part is visualized using a toner.

In regard to the other, ordinary apparatuses may be employed.

EXAMPLES

In the following, the advantages of the present invention are illustrated with reference to Examples.

Example 1

Carrier Preparation Example 1

In a high speed stirring type mixer, were mixed with stirring 100 weight parts of particles (specific gravity 5.2) of a magnetic substance composed of a magnetite having a volume average particle diameter of 45 $\mu$m, 2.8 weight parts of stylene-methylmethacrylate copolymer (Tg=103° C., Tsp=230° C.) having a number average particle diameter of 2.5 $\mu$m, and 1.2 weight parts of magnesium oxide having a number average particle diameter of 0.8 $\mu$m, a BET specific surface area of 76 $m^2/g$ and a magnesium atom containing ratio of 40 (the number of atoms by percent) at the surface portion at a material's temperature of 30° C. and a peripheral speed of a stirrer blade of 10 m/second for 20 minutes, and a mixture was prepared in which the coating resin and the magnesium atom containing material are adhered on the surface of the particle of the magnetic substance. The resulting mixture was then mixed with stirring at a material's temperature of 110° C. and a peripheral speed of the stirrer blade of 10 m/second for 20 minutes in the high speed stirring type mixer. By applying repeatedly mechanical impact force to the mixture, Carrier 1 was prepared in which the resin coating layer to which magnesium oxide was dispersed and added was formed on the surface of the particle of the magnetic substance comprised of the magnetite. The magnesium atom containing ratio of in the surface portion of Carrier 1 was 3.8 (the number of atoms by percent).

Carrier Preparation Example 2

In a high speed stirring type mixer, were mixed with stirring 100 weight parts of particles (specific gravity 5.2 $g/cm^3$) of a magnetic substance composed of a magnetite having a volume average particle diameter of 45 $\mu$m, 2.8 weight parts of stylene-methylmethacrylate copolymer (Tg=103° C., Tsp=232° C.) having a number average particle diameter of 2.5 $\mu$m at a material's temperature of 30° C. and a peripheral speed of a stirrer blade of 10 m/second for 20 minutes, and a mixture was prepared in which the coating resin was adhered on the particle of the magnetic substance. Furthermore, to the resulting mixture, 1.2 weight parts of magnesium oxide having a number average particle diameter of 0.8 $\mu$m, a BET specific surface area of 76 $m^2/g$ and a magnesium atom containing ratio in the surface portion of 40 (the number of atoms by percent) were added and mixed for 20 minutes under the same conditions and a mixture was prepared in which the coating resin and magnesium atom containing material were adhered on the surface of the particle of the magnetic substance.

The resulting mixture was then heated at a material's temperature of 110° C. and mixed with stirring at a peripheral speed of the stirrer blade of 10 m/second for 20 minutes in the high speed stirring type mixer. By applying repeatedly mechanical impact force to the mixture, Carrier 2 was prepared in which the resin coating layer to which magnesium oxide was dispersed and added was formed on the particle of the magnetic substance composed of the magnetite. The magnesium atom containing ratio in the surface portion of Carrier 2 was 13.7 (the number of atoms by percent).

Carrier Preparation Example 3

Carrier 3 was prepared in the same manner as in Carrier Preparation Example 2 except that the particles of the magnetic substance and cyclohexylmethacrylate-methylmethacrylate were mixed with stirring for 60 minutes. The magnesium atom containing ratio in the surface portion of Carrier 3 was 24.8 (the number of atoms by percent).

Comparative Carrier Preparation Example 1

Comparative Carrier 1 was prepared in the same manner as in Carrier Preparation Example 1 except that magnesium oxide was not employed. The magnesium atom containing ratio in the surface portion of Comparative Carrier 1 was 0.4 (the number of atoms by percent).

Comparative Carrier Preparation Example 2

Into a high speed stirring type mixer were added again 102.8 weight parts of Comparative Carrier 1 prepared in the same manner as in Carrier Preparation Example 1, and further 1.2 weight parts of magnesium oxide having a number average particle diameter of 0.8 $\mu$m, a BET specific surface area of 76 $m^2/g$ and a magnesium atom containing ratio in the surface portion of 40 (the number of atoms by percent), and the resulting mixture was uniformly mixed with stirring at a material's temperature of 30° C. and the peripheral speed of the stirrer blade of 10 m/second for 20 minutes. The resulting mixture was mixed in the high speed stirring type mixer with stirring at a material's temperature of 120° C. and the peripheral speed of the stirrer blade of 10 m/second for 20 minutes. By applying repeatedly mechanical impact force to the mixture, Comparative Carrier 2 was prepared in which magnesium oxide was hit to the surface portion of the resin-coated layer. The magnesium atom containing ratio in the surface portion of Comparative Carrier 2 was 35.1 (the number of atoms by percent).

The magnesium atom containing ratio in the surface portion of each of the Carriers 1 to 3 and Comparative Carriers 1 to 2 is tabulated in Table 1.

TABLE 1

| Carrier of Present Invention and Comparative Carrier | Magnesium Atom Containing Ratio in Surface Portion of Carrier |
|---|---|
| Carrier 1 | 3.8% |
| Carrier 2 | 13.7% |
| Carrier 3 | 24.8% |
| Comparative Carrier 1 | 0.4% |
| Comparative Carrier 2 | 35.1% |

Toner Preparation Example

| | |
|---|---|
| Polyester resin | 100 weight parts |
| Carbon black | 10 weight parts |
| Polypropylene | 4 weight parts |

The above compounds were mixed, kneaded, pulverized and classified to prepare colored particles having a volume average particle diameter of 8.5 $\mu$m. Further, the volume average particle diameter of the colored particles is herein the value measured using a Coulter counter-TA-II type.

To 100 weight parts of the colored particles, was added 0.6 weight part of hydrophobic silica particles (diameter 12 nm) and a toner was prepared by mixing the resulting mixture using a Henschel mixer.

Examples 1 to 3 and Comparative Examples 1 to 2

The developers (Developers 1 to 3) of the present invention and comparative developers (Comparative Developers 1 to 2) were prepared by mixing 93 weight parts of each of the aforementioned Carriers 1 to 3 and Comparative Carriers 1 to 2 with 3 weight parts of the aforementioned toner using a V type mixer.

Practical Copying test

Each of Developers 1 to 3 of the present invention and Comparative Developer 1 to 2 which were prepared as mentioned above was tested under the following conditions using a modified electrophotographic copier Konica 7050 (manufactured by Konica Corp.), while accomplishing a practical copying test of 100,000 copies and evaluations were performed for items; (1) presence of stain in the inside of the machine caused by toner scattering and (2) degree of the formation of background deposits on images.

The evaluation methods for the aforementioned two items are as follows.

Stain in the Inside of the Machine Caused by Toner Scattering

The inside of the machine was visually observed every 10,000 copies for each of the practical copying tests and the evaluation was performed according to the following scale.

A: Good; no stain is found in the inside of the machine

B: Stain is partially found on the lid (near the sleeve) of the developing device.

C: Stain is found on all the surface of the lid of the developing device.

D: Stain is found in the most part of the inside of the machine and causes a problem for commercial use.

Degree of the Formation of Background Deposits on Images

The relative density of a white part of an output image every 10,000 copies for each of the practical copying tests was measured using an image densitometer RD-918 type (manufactured by Macbeth Co.). The measured value of 0.1 or higher causes a problem for commercial use.

Furthermore, modifications performed for imaging and imaging conditions are as follows.

Modifications and Imaging Conditions

VH=−750 V, VL=−50 V

DC component of developing bias: −650 V

AC component of developing bias: frequency 8 kHz, 2.6 kV

Distance between photoreceptor and sleeve: 550 $\mu$m

Thickness of developer layer: 250 $\mu$m

Moreover, the developer layer regulating member in the developing device was modified so that the thickness of the developer layer was regulated at the predetermined value.

Material of developer holding member: aluminum

Metal stick for regulating developer layer: non-magnetic SUS, 6 $\phi$ round stick Copying condition and black image area ratio of original are shown in Table 2.

Table 3 shows the results on stain in the inside of the machine caused by toner scattering and Table 4 shows measurement results of the relative density of the white parts.

With Comparative Example 1, the practical copying test was terminated at 20,000 copies because toner scattering and background deposits on images were remarkably caused. With Comparative Example 2, the practical copying test was also terminated at 30,000 copies because toner scattering and background deposits on images were remarkably caused.

TABLE 2

| Number of Copies | Copying Conditions | Black image area Ratio of Original |
|---|---|---|
| 1 to 10,000 | 20° C. 50% RH | 6% |
| 10,001 to 20,000 | 25° C. 20% RH | 6% |
| 20,001 to 30,000 | 30° C. 80% RH | 6% |
| 30,001 to 40,000 | 25° C. 20% RH | 20% |
| 40,001 to 50,000 | 25° C. 20% RH | 3% |
| 50,001 to 60,000 | 25° C. 20% RH | 6% |
| 60,001 to 70,000 | 30° C. 80% RH | 20% |
| 70,001 to 80,000 | 30° C. 20% RH | 6% |
| 80,001 to 90,000 | 25° C. 80% RH | 6% |
| 90,001 to 100,000 | 25° C. 20% RH | 20% |

TABLE 3

Stain in Inside of Machine Caused by Toner Scattering

| | | Number of Copies | | | | | | | | | | |
|---|---|---|---|---|---|---|---|---|---|---|---|---|
| Developer | Carrier | 1 | 10,000 | 20,000 | 30,000 | 40,000 | 50,000 | 60,000 | 70,000 | 80,000 | 90,000 | 100,000 |
| 1 | 1 | A | A | A | A | A | A | A | A | B | B | B |
| 2 | 2 | A | A | A | A | A | A | A | A | A | A | A |
| 3 | 3 | A | A | A | A | A | A | A | A | A | A | A |
| Comparative 1 | Comparative 1 | B | D | D | — | — | — | — | — | — | — | — |
| Comparative 2 | Comparative 2 | A | A | A | D | — | — | — | — | — | — | — |

TABLE 4

Background deposits on images

| | | Number of Copies | | | | | | | | | | |
|---|---|---|---|---|---|---|---|---|---|---|---|---|
| Developer | Carrier | 1 | 10,000 | 20,000 | 30,000 | 40,000 | 50,000 | 60,000 | 70,000 | 80,000 | 90,000 | 100,000 |
| 1 | 1 | 0.000 | 0.002 | 0.002 | 0.004 | 0.008 | 0.012 | 0.016 | 0.022 | 0.032 | 0.038 | 0.044 |
| 2 | 2 | 0.001 | 0.002 | 0.000 | 0.003 | 0.004 | 0.006 | 0.010 | 0.008 | 0.012 | 0.016 | 0.016 |
| 3 | 3 | 0.000 | 0.001 | 0.002 | 0.002 | 0.003 | 0.004 | 0.008 | 0.010 | 0.010 | 0.012 | 0.012 |
| Comparative 1 | Comparative 1 | 0.032 | 0.104 | 0.229 | — | — | — | — | — | — | — | — |
| Comparative 2 | Comparative 2 | 0.002 | 0.004 | 0.012 | 0.196 | — | — | — | — | — | — | — |

As clearly shown in Tables 2 to 4, Developers 1 to 3 results consistently in excellent charge rising properties for a long period of time and neither toner scattering nor background deposits on images are caused during the practical copying test of 100,000 copies and excellent images are generated because the performance is exhibited irrespective of the ambient conditions.

Example 2

Carrier Preparation Example 4

In a high speed stirring type mixer, were mixed with stirring 100 weight parts of particles (specific gravity 5.2) of the magnetic substance composed of a magnetite having a volume average particle diameter of 45 $\mu$m, 2.8 weight parts of cyclohexylmethacrylate-methylmethacrylate copolymer (Tg=111° C., Tsp=270° C.) having a number average particle diameter of 2.5 $\mu$m, and 1.2 weight parts of magnesium oxide prepared by the wet process having a number average particle diameter of 0.8 $\mu$m, a BET specific surface area of 76 $m^2/g$ and a weight decreasing ratio of 9.8 weight percent in the temperature range of 200 to 500° C when heated at a rate of 5° C./minute under atmosphere, at a material's temperature of 30° C. and a peripheral speed of a stirrer blade of 10 m/second for 20 minutes. The resulting mixture was then mixed with stirring at a material's temperature of 120° C. and a peripheral speed of the stirrer blade of 10 m/second for 20 minutes in the high speed stirring type mixer. By applying repeatedly mechanical impact force to the mixture, Carrier 4 was prepared in which the resin coating layer to which magnesium oxide was dispersed and added was formed on the surface of the particle of the magnetic substance composed of the magnetite.

Carrier Preparation Example 5

Carrier 5 wherein the resin coating layer to which magnesium oxide was dispersed and added was formed on the surface of the particle of the magnetic substance composed of the magnetite was prepared in the same manner as in Carrier Preparation Example 4 except that magnesium oxide prepared by the wet process having a weight decreasing ratio of 17.7 weight percent in the temperature range of 200 to 500° C. when heated at a rate of 5° C./minute under atmosphere was employed.

Carrier Preparation Example 6

Carrier 6 wherein the resin coating layer to which magnesium oxide was dispersed and added was formed on the surface of the particle of the magnetic substance composed of the magnetite was prepared in the same manner as in Carrier Preparation Example 4 except that magnesium oxide prepared by the wet process having a weight decreasing ratio of 2.8 weight percent in the temperature range of 200 to 500° C. when heated at a rate of 5° C./minute under atmosphere was employed.

Carrier Preparation Example 7

Carrier 7 wherein the resin coating layer to which magnesium oxide was dispersed and added was formed on the surface of the particle of the magnetic substance composed of the magnetite was prepared in the same manner as in Carrier Preparation Example 4 except that magnesium oxide prepared by the wet process having a weight decreasing ratio of 29.8 weight percent in the temperature range of 200 to 500° C. when heated at a rate of 5° C./minute under atmosphere was employed.

Table 5 shows the weight decreasing ratio "W (loss)" in the temperature range of 200 to 500° C. when the Carriers 4 to 7 are heated at a rate of 5° C./minute under atmosphere.

TABLE 5

| Carrier of Present Invention | W (loss) (weight %) |
|---|---|
| Carrier 4 | 9.8 |
| Carrier 5 | 17.7 |
| Carrier 6 | 2.8 |
| Carrier 7 | 29.8 |

Toner Preparation Example

| | |
|---|---|
| Polyester resin | 100 weight parts |
| Carbon black | 10 weight parts |
| Polypropylene | 4 weight parts |

The above compounds were mixed, kneaded, pulverized and classified to prepare colored particles having a volume average particle diameter of 8.5 μm. Further, the volume average particle diameter of the colored particles herein is the value measured using a Coulter counter-TA-II type.

To 100 weight parts of the colored particles, was added 0.6 weight part of hydrophobic silica particles (diameter 12 nm) and a toner was prepared by mixing the resulting mixture using a Henschel mixer.

Developers 4 to 7 were prepared by mixing 93 weight parts of each of the aforementioned Carriers 4 to 7 with 3 weight parts of the aforementioned toner using a V type mixer.

Practical Copying test

Each of Developers 4 to 7 which were prepared as mentioned above was tested under the following conditions using a modified electrophotographic copier Konica 7050 (manufactured by Konica Corp.), while accomplishing a practical copying test of 100,000 copies and evaluations were performed for items; (1) transition of image density (2) stain in the inside of the machine caused by toner scattering and (3) degree of the formation of background deposits on images.

The evaluation methods for the aforementioned two items are as follows.

(1) Transition of Image Density

The relative density on a part of 2 cm×5 cm of every 10,000 copies for each of practical copying tests was measured using an image densitometer RD-918 type (manufactured by Macbeth Co.)

(2) Stain in the Inside of the Machine Caused by Toner Scattering

The inside of the machine was visually observed every 10,000 copies for each of practical test runs and the evaluation was performed according to the following scale.

A: Good; no stain is found in the inside of the machine

B: Stain is partially found on the upper lid (near the sleeve) of the developing device.

C: Stain is found on all the surface of the upper lid of the developing device.

D: Stain is found in the most part of the inside of the machine and causes a problem for commercial use.

(3) Degree of the Formation of Background Deposits on Images

The relative density of a white part of an output image of every 10,000 copies for each of practical copying tests was measured using an image densitometer RD-918 type (manufactured by Macbeth Co.). The measured value of 0.1 or higher causes a problem for commercial use.

Furthermore, modifications employed for imaging and imaging conditions are as follows.

Modifications and copying Conditions

VH=−750 V, VL=−50 V

DC component of developing bias: −650 V

AC component of developing bias: frequency 8 kHz, 2.6 kV

Distance between photoreceptor and sleeve: 550 μm

Thickness of developer layer: 250 μm

Moreover, the developer layer regulating member in the developing device was modified so that the thickness of the developer layer was regulated at the predetermined value.

Material of developer holding member: aluminum

Metal stick for regulating developer layer: non-magnetic SUS, 6 ϕ round stick

Copying condition and black image area ratio of original are shown in Table 6.

TABLE 6

| Number of Copies | Copying Conditions | Black image area Ratio of Original |
|---|---|---|
| 1 to 10,000 | 20° C. 50% RH | 6% |
| 10,001 to 20,000 | 25° C. 20% RH | 6% |
| 20,001 to 30,000 | 30° C. 80% RH | 6% |
| 30,001 to 40,000 | 25° C. 20% RH | 20% |
| 40,001 to 50,000 | 25° C. 20% RH | 3% |
| 50,001 to 60,000 | 25° C. 20% RH | 6% |
| 60,001 to 70,000 | 30° C. 80% RH | 6% |
| 70,001 to 80,000 | 30° C. 80% RH | 20% |
| 80,001 to 90,000 | 25° C. 20% RH | 6% |
| 90,001 to 100,000 | 25° C. 20% RH | 20% |

Table 7 shows results on the transition of the image density, Table 8 shows results on the stain in the inside of the machine caused by toner scattering. Tables 6 and 10 show the measurement results on the relative image density.

TABLE 7

| | | Number of Copies | | | | | | | | | | |
|---|---|---|---|---|---|---|---|---|---|---|---|---|
| Developer | Carrier | 1 | 10,000 | 20,000 | 30,000 | 40,000 | 50,000 | 60,000 | 70,000 | 80,000 | 90,000 | 100,000 |
| 4 | 4 | 1.44 | 1.44 | 1.43 | 1.44 | 1.43 | 1.45 | 1.44 | 1.44 | 1.42 | 1.42 | 1.40 |
| 5 | 5 | 1.44 | 1.44 | 1.43 | 1.44 | 1.43 | 1.45 | 1.44 | 1.44 | 1.42 | 1.42 | 1.40 |
| 6 | 6 | 1.44 | 1.44 | 1.43 | 1.44 | 1.43 | 1.45 | 1.44 | 1.44 | 1.42 | 1.42 | 1.40 |
| 7 | 7 | 1.44 | 1.44 | 1.43 | 1.44 | 1.43 | 1.45 | 1.44 | 1.44 | 1.42 | 1.42 | 1.40 |

TABLE 8

| Developer | Carrier | Number of Copies | | | | | | | | | | |
|---|---|---|---|---|---|---|---|---|---|---|---|---|
| | | 1 | 10,000 | 20,000 | 30,000 | 40,000 | 50,000 | 60,000 | 70,000 | 80,000 | 90,000 | 100,000 |
| 4 | 4 | A | A | A | A | A | A | A | A | B | B | B |
| 5 | 5 | A | A | A | A | A | A | A | A | A | A | A |
| 6 | 6 | A | A | A | A | A | A | A | A | A | A | A |
| 7 | 7 | A | A | A | A | A | A | A | A | A | A | A |

TABLE 9

| Developer | Carrier | Number of Copies | | | | | |
|---|---|---|---|---|---|---|---|
| | | 1 | 10,000 | 20,000 | 30,000 | 40,000 | 50,000 |
| 4 | 4 | 0.001 | 0.001 | 0.002 | 0.002 | 0.004 | 0.006 |
| 5 | 5 | 0.001 | 0.001 | 0.002 | 0.002 | 0.004 | 0.006 |
| 6 | 6 | 0.001 | 0.002 | 0.001 | 0.004 | 0.004 | 0.006 |
| 7 | 7 | 0.001 | 0.002 | 0.001 | 0.004 | 0.004 | 0.006 |

TABLE 10

| Developer | Carrier | Number of Copies | | | | |
|---|---|---|---|---|---|---|
| | | 60,000 | 70,000 | 80,000 | 90,000 | 100,000 |
| 4 | 4 | 0.006 | 0.006 | 0.008 | 0.008 | 0.010 |
| 5 | 5 | 0.006 | 0.008 | 0.010 | 0.008 | 0.012 |
| 6 | 6 | 0.008 | 0.008 | 0.010 | 0.010 | 0.012 |
| 7 | 7 | 0.008 | 0.012 | 0.012 | 0.012 | 0.016 |

As clearly shown in Tables 6 to 10, in the case of employing Developers 4 to 7, excellent charge rising properties are exhibited consistently for a long period of time. Furthermore, because the performance is independent of the variation in ambient conditions, neither toner scattering nor background deposits on images are caused, while accomplishing a practical copying test of 100,000 copies and excellent images are prepared.

Example 3

Carrier Preparation Example 8

In a high speed stirring type mixer, were mixed with stirring 100 weight parts of particles (specific gravity 5.2 g/cm$^3$) of a magnetic substance composed of a magnetite having a volume average particle diameter of 45 $\mu$m, 2.8 weight parts of stylene-methylmethacrylate copolymer (Tg=103° C., Tsp=230° C.) having a number average particle diameter of 2.5 $\mu$m, and 1.2 weight parts of magnesium oxide having a number average particle diameter of 0.8 $\mu$m, a BET specific surface area of 76 m$^2$/g and a magnesium atom containing ratio of 40 (the number of atoms by percent) at the surface portion at a material's temperature of 30° C. and a peripheral speed of a stirrer blade of 10 m/second for 20 minutes, and a mixture was prepared in which the coating resin and the magnesium atom containing material are adhered on the surface of the particle of the magnetic substance. The resulting mixture was then mixed with stirring at a material's temperature of 110° C. and a peripheral speed of the stirrer blade of 10 m/second for 20 minutes in the high speed stirring type mixer. By applying repeatedly mechanical impact force to the mixture, Carrier 1 was prepared in which the resin coating layer to which magnesium oxide was dispersed and added was formed on the surface of the particle of the magnetic substance comprised of the magnetite. The magnesium atom containing ratio of in the surface portion of Carrier 8 was 3.8 (the number of atoms by percent).

Carrier Preparation Example 9

Carrier 9 of the present invention was prepared in the same manner as in Carrier Preparation Example 1 except that the particles of the magnetic substance and the stylene-methylmethacrylate copolymer resin were mixed with stirring for 60 minutes.

Toner Preparation Example

| | |
|---|---|
| Polyester resin having 120P composition | 100 weight parts |
| Carbon black | 10 weight parts |
| Polypropylene | 4 weight parts |

The above compounds were mixed, kneaded, pulverized and classified to prepare colored particles having a volume average particle diameter of 8.5 $\mu$m. Further, the volume average particle diameter of the colored particles is herein a value measured using a Coulter counter-TA-II type.

To 100 weight parts of the colored particles, was added 0.6 weight part of fine hydrophobic silica particles (diameter 12 nm) and fine hydrophobic titania particles, and a toner was prepared by mixing the resulting mixture using a Henschel mixer.

Developers 8 and 9 were prepared by mixing 93 weight parts of each of the aforementioned Carriers 8 and 9 with 3 weight parts of the aforementioned toner using a V type mixer.

Practical Copying test

The same test as in Example 1 was performed for each of Developers 8 and 9 of the present invention prepared as described above.

Table 11 shows the results on the stain in the inside of the machine caused by toner scattering, and Tables 12 and 13 the measurement results on the relative density on white parts, respectively.

TABLE 11

| Developer | Carrier | Number of Copies | | | | | | | | | | |
|---|---|---|---|---|---|---|---|---|---|---|---|---|
| | | 1 | 10,000 | 20,000 | 30,000 | 40,000 | 50,000 | 60,000 | 70,000 | 80,000 | 90,000 | 100,000 |
| 8 | 8 | A | A | A | A | A | A | A | A | A | A | A |
| 9 | 9 | A | A | A | A | A | A | A | A | A | A | A |

TABLE 12

| Developer | Carrier | Number of Copies 1 | 10,000 | 20,000 | 30,000 | 40,000 | 50,000 |
|---|---|---|---|---|---|---|---|
| 8 | 8 | 0.001 | 0.002 | 0.000 | 0.003 | 0.004 | 0.006 |
| 9 | 9 | 0.000 | 0.001 | 0.002 | 0.002 | 0.003 | 0.004 |

TABLE 13

| Developer | Carrier | Number of Copies 60,000 | 70,000 | 80,000 | 90,000 | 100,000 |
|---|---|---|---|---|---|---|
| 8 | 8 | 0.010 | 0.008 | 0.012 | 0.016 | 0.016 |
| 9 | 9 | 0.008 | 0.010 | 0.010 | 0.012 | 0.012 |

As clearly shown in Tables 11 to 13, in the case of employing Developers 8 and 9, excellent charge rising properties are exhibited consistently for a long period of time. Furthermore, because the performance is independent of the variation in ambient conditions, neither toner scattering nor background deposits on images are caused, while accomplishing a practical copying test of 100,000 copies and excellent images are prepared.

In accordance with the present invention, there may be provided a carrier for developing an electrostatic image in which excellent charge rising properties are consistently exhibited for a long period of time and neither toner scattering nor background deposits on images are caused, its preparation method, a developer for an electrostatic image employing the carrier and a developing method.

We claim:

1. A carrier for a developer developing an electrostatic image wherein the carrier contains magnesium from 2.0 to 25.0 by means of number of atoms by percent in surface portion.

2. A carrier of claim 1 wherein the carrier comprises a magnetic substance coated with a resin.

3. A carrier of claim 2 wherein the resin coated on the magnetic substance contains magnesium atom containing material.

4. A carrier of claim 3 wherein the magnesium atom containing material is magnesium oxide, magnesium hydroxide or magnesium carbonate.

5. A carrier of claim 3 wherein weight decreasing ratio of the magnesium atom containing material is from 2 to 30 percent by weight in the temperature region of 200 to 500° C. upon heating at a rate of 5° C./minute under atmosphere.

6. A carrier of claim 3 wherein BET specific surface area of the magnesium atom containing material is from 20 to 300 $m^2/g$.

7. A carrier of claim 3 wherein number average particle diameter of the magnesium atom containing material is from 10 nm to 3 $\mu$m.

8. A carrier of claim 3 wherein resin has a glass transition point Tg of 50 to 200° C. and a softening point of 80 to 300° C.

9. A carrier of claim 1 wherein a volume average particle diameter of the carrier is 15 to 80 $\mu$m.

10. A developers for developing an electrostatic image comprising a toner and carrier wherein the carrier contains magnesium from 2.0 to 25.0 by means of number of atoms by percent in surface portion.

* * * * *

UNITED STATES PATENT AND TRADEMARK OFFICE

CERTIFICATE OF CORRECTION

PATENT NO : 5,932,388
DATED : August 3, 1999
INVENTOR(S) : T. Umeno et al.

It is certified that error appears in the above-identified patent and that said Letters Patent is hereby corrected as shown below:

Title page,

Item [30], line 3, change "8-283651" to --8-293651--.

Signed and Sealed this
Twenty-fifth Day of January, 2000

*Attest:*

*Attesting Officer*

*Acting Commissioner of Patents and Trademarks*